US012053666B2

(12) United States Patent
Hsu

(10) Patent No.: US 12,053,666 B2
(45) Date of Patent: Aug. 6, 2024

(54) CLIMBING MACHINE HAVING SINGLE CIRCULATING TRANSMISSION PATH STRUCTURE

(71) Applicant: Chih-Yung Hsu, Tainan (TW)

(72) Inventor: Chih-Yung Hsu, Tainan (TW)

( * ) Notice: Subject to any disclaimer, the term of this patent is extended or adjusted under 35 U.S.C. 154(b) by 131 days.

(21) Appl. No.: 17/806,331

(22) Filed: Jun. 10, 2022

(65) Prior Publication Data

US 2023/0381575 A1 Nov. 30, 2023

(30) Foreign Application Priority Data

May 27, 2022 (TW) ..... 111119931

(51) Int. Cl.
*A63B 22/00* (2006.01)
*A63B 21/00* (2006.01)
*A63B 22/20* (2006.01)

(52) U.S. Cl.
CPC ..... *A63B 22/001* (2013.01); *A63B 21/00192* (2013.01); *A63B 21/151* (2013.01); *A63B 21/4034* (2015.10); *A63B 21/4035* (2015.10); *A63B 22/205* (2013.01)

(58) Field of Classification Search
CPC ..... A63B 22/001; A63B 21/00192; A63B 21/151; A63B 21/4034; A63B 21/4035; A63B 22/205
See application file for complete search history.

(56) References Cited

U.S. PATENT DOCUMENTS 5,040,785 A * 8/1991 Charnitski ..... A63B 23/0417 482/52
5,492,515 A * 2/1996 Charnitski ..... A63B 22/001 482/37
11,077,336 B2 * 8/2021 Carruthers ..... A63B 21/4035
11,235,197 B2 * 2/2022 Carruthers ..... A63B 22/04
2022/0395735 A1 * 12/2022 Sun ..... A63B 22/0005

FOREIGN PATENT DOCUMENTS

TW M574060 U 2/2019

* cited by examiner

*Primary Examiner* — Andrew S Lo
(74) *Attorney, Agent, or Firm* — Rosenberg, Klein & Lee

(57) ABSTRACT

A climbing machine having a single circulating transmission path structure is disclosed. The climbing machine includes a frame body, a first slide rail assembly, a second slide rail assembly, and a transmission unit. A transmission assembly of the transmission unit is continuously connected with a first pedal slider, a second pedal slider, a first handle slider, a second handle slider to form a single circulating transmission path instead of two independent paths on both sides of the frame body. The smoothness of the transmission path can be improved without the need for timing belts or connecting belts.

9 Claims, 19 Drawing Sheets

CLIMBING MACHINE HAVING SINGLE CIRCULATING TRANSMISSION PATH STRUCTURE

FIELD OF THE INVENTION

The present invention relates to a climbing machine, and more particularly to a climbing machine having a single circulating transmission path structure.

BACKGROUND OF THE INVENTION

A climbing machine is a common exercise machine, which includes displaceable pedals and handles disposed on vertical rails. The operator alternately treads on the pedals with both feet and grasps the handles with both hands to simulate rock climbing, so that the operator can practice the coordinated movements of hands and feet for rock climbing, achieving the sports and fitness effect.

Chinese Utility Model Publication No. CN210205813U discloses a climbing machine, including a frame, a damper, a synchronous unit, and two fitness modules. The damper is mounted on the frame. The damper has a power input shaft. Synchronous unit includes a timing gear, a timing belt and two pinch pulleys. The timing belt is looped around the timing gear. The timing gear is disposed on the power input shaft. The pinch pulleys are disposed on both sides of the timing gear and are rotatably installed on the frame. The pinch pulleys are pressed against the outside of the timing belt on the corresponding sides. The two fitness modules are disposed on both sides of the frame. The fitness module includes a climbing mechanism and a guide mechanism for guiding the climbing mechanism to reciprocate up and down. The climbing mechanism includes a handle, a pedal and a connecting frame. The handle and the pedal are disposed on the connecting frame, respectively. One end of the timing belt is connected to one connecting frame, and the other end of the timing belt is connected to the other connecting frame.

In the above-mentioned patent, because the connecting frames are disposed on both sides of the frame, it is necessary to use the timing belt and a connecting belt to connect the connecting frames on both sides. However, one side of the connecting belt is only provided with a single guide wheel. When the pedals are raised, the connecting belt may rub against the support. If it is matched with a timing gear and two pinch pulleys like the timing belt, it is not conducive to the simplification of the number of components.

SUMMARY OF THE INVENTION

The primary object of the present invention is to provide a climbing machine having a single circulating transmission path structure. The climbing machine comprises a frame body, a first slide rail assembly, a second slide rail assembly, a first pedal slider, a second pedal slider, a first handle slider, a second handle slider, and a transmission unit. The frame body includes a support frame and a base. The base is located on an XY plane. The support frame stands on the base, and extends in a Z direction or extends obliquely relative to the Z direction. The XY plane is formed by an X direction and a Y direction that are perpendicular to each other. The Z direction is perpendicular to the XY plane. The X direction and the Z direction form an XZ plane. The Y direction and the Z direction form a YZ plane. The first slide rail assembly includes a first right slide rail and a first left slide rail that are disposed on the support frame. The second slide rail assembly includes a second right slide rail and a second left slide rail that are disposed on the support frame. The first pedal slider is slidably disposed on the first right slide rail. The second pedal slider is slidably disposed on the first left slide rail. The first handle slider is slidably disposed on the second right slide rail. The second handle slider is slidably disposed on the second left slide rail. The transmission unit is disposed on the support frame. The transmission unit includes a rolling assembly and a transmission assembly. The transmission assembly is continuously looped around the rolling assembly and continuously connects the first pedal slider, the second pedal slider, the second handle slider and the first handle slider to form a single circulating transmission path, such that the first pedal slider, the second pedal slider, the first handle slider and the second handle slider can slide on the first slide rail assembly and the second slide rail assembly synchronously through the transmission unit.

Preferably, the first right slide rail and the first left slide rail are spaced apart by a distance in the X direction and are juxtaposed on the support frame. The second right slide rail and the second left slide rail are spaced apart by the distance in the X direction and are juxtaposed on the support frame.

Preferably, the transmission assembly includes a first transmission member, a second transmission member, a third transmission member, and a fourth transmission member. The rolling assembly includes a first roller, a second roller, a third roller, and a fourth roller. One end of the first transmission member is connected to the first pedal slider and looped around the first roller. Another end of the first transmission member is connected to the second pedal slider. One end of the second transmission member is connected to the second pedal slider and looped around the second roller. Another end of the second transmission member is connected to the second handle slider. One end of the third transmission member is connected to the second handle slider and looped around the third roller. Another end of the third transmission member is connected to the first handle slide. One end of the fourth transmission member is connected to the first handle slider and looped around the fourth roller. Another end of the fourth transmission member is connected to the first pedal slider.

Preferably, the first transmission member is directly connected to the second transmission member, the second transmission member is directly connected to the third transmission member, and the third transmission member is directly connected to the fourth transmission member.

Preferably, the climbing machine further comprises a resistance unit disposed on the frame body. The transmission unit is connected to the resistance unit.

Preferably, the resistance unit includes a driving wheel, a first driven wheel, a second driven wheel, a third driven wheel, a resistance wheel, a fifth transmission member, a sixth transmission member, and a resistance member. The driving wheel, the fourth roller and the second roller are all disposed on a first rotating shaft. The driving wheel and the fourth roller are connected to the first rotating shaft and rotated simultaneously along with the first rotating shaft. The second roller idly rotates on the first rotating shaft. The fifth transmission member connects the driving wheel and the first driven wheel. The first driven wheel and the second driven wheel are connected to a second rotating shaft and rotated simultaneously along with the second rotating shaft. The sixth transmission member connects the second driven wheel and the third driven wheel. The third driven wheel and the resistance wheel are connected to a third rotating shaft and rotated simultaneously along with the third rotating shaft. The resistance member is disposed on the frame body and adjacent to the resistance wheel. A resistance of the resistance wheel is controlled by the resistance member. A force from the driving wheel is transmitted to the resistance wheel through the fifth transmission member, the first driven wheel, the second driven wheel, the sixth transmission member and the fifth transmission member in sequence.

Preferably, the first roller and the third roller are disposed at one end of the support frame away from the base. An included angle θ is defined between an axis lines of each of the first roller and the third roller and the XZ plane. The included angle θ is between 70 degrees and 90 degrees. The second roller and the fourth roller are disposed at another end of the support frame close to the base. An axis line of the first rotating shaft is parallel to the X direction.

Preferably, the resistance member is a magnetoresistive member. The resistance unit further includes a control member disposed on the frame body. The control member is connected to the magnetoresistive member. The control member is configured to control a relative position between the magnetoresistive member and the resistance wheel to change the resistance of the resistance wheel.

Preferably, the first slide rail assembly and the second slide rail assembly are spaced apart by a distance in the Y direction and are arranged on the support frame side by side. The support frame has a support frame top end. The first slide rail assembly has a first slide rail top end. The second slide rail assembly has a second slide rail top end. The first slide rail top end and the second slide rail top end are both lower than an operator's eye position in the Z direction.

Preferably, a first pedal is connected to the first pedal slider, a second pedal is connected to the second pedal slider, a first handle is connected to the first handle slider, and a second handle is connected to the second handle slider.

According to the above-mentioned technical features, the following effects can be preferably achieved.

1. A single circulating transmission path is formed by the transmission assembly, instead of two independent paths on both sides of the frame body. There is no need for additional timing belts or connecting belts, which can simplify the number of components and improve the smoothness of the transmission path.

2. The transmission assembly continuously connects the first pedal slider, the second pedal slider, the second handle slider and the first handle slider, which allows the operator's right hand to move along with the left foot and the left hand to move along with the right foot. It is more in line with the actual exercise habits.

3. With the cooperation of four rollers, the transmission assembly forms a single circulating transmission path smoothly through a single transmission member or a plurality of transmission members.

4. With the resistance unit, the operator can adjust the desired resistance of operation by himself to enhance the training effect.

5. The axis lines of the first roller and the third roller form an included angle with the XZ plane, which can simulate the inclination for climbing.

6. The first slide rail assembly and the second slide rail assembly are arranged side by side to reduce the heights of the support frame top end, the first slide rail top end and the second slide rail top end, so that the operator's sight will not be blocked by the first slide rail assembly and the second slide rail assembly.

7. The first slide rail assembly and the second slide rail assembly are arranged side by side in the Y direction, reducing the distance between the pedals and the distance between the handles and allowing the operator to operate more naturally.

DESCRIPTION OF THE PREFERRED EMBODIMENTS

According to the above technical features, the main effect of the present invention will be clearly presented in the following embodiments. In the following embodiments, the directional terms, such as left, right, front, rear, up, down, far, near, etc., refer to the relative orientation recognized by an operator A when the operator A stands on the climbing machine provided by the present invention to do exercise. In terms of the relative orientation recognized by the operator A, coordinate axis directions and planes that are perpendicular to each other in space are also used in each embodiment, including: an X direction, a Y direction, and a Z direction. The X direction and the Y direction form an XY plane. The Y direction and the Z direction form a YZ plane. The X direction and the Z direction form an XZ plane. The XY plane is parallel to the ground. The climbing machine of the present invention is in a state of standing on the ground. The above-mentioned directional terms, coordinate axis directions and planes are used to facilitate the understanding of the spatial configuration of the present invention, and are not intended to limit the present invention.

Figure 1:
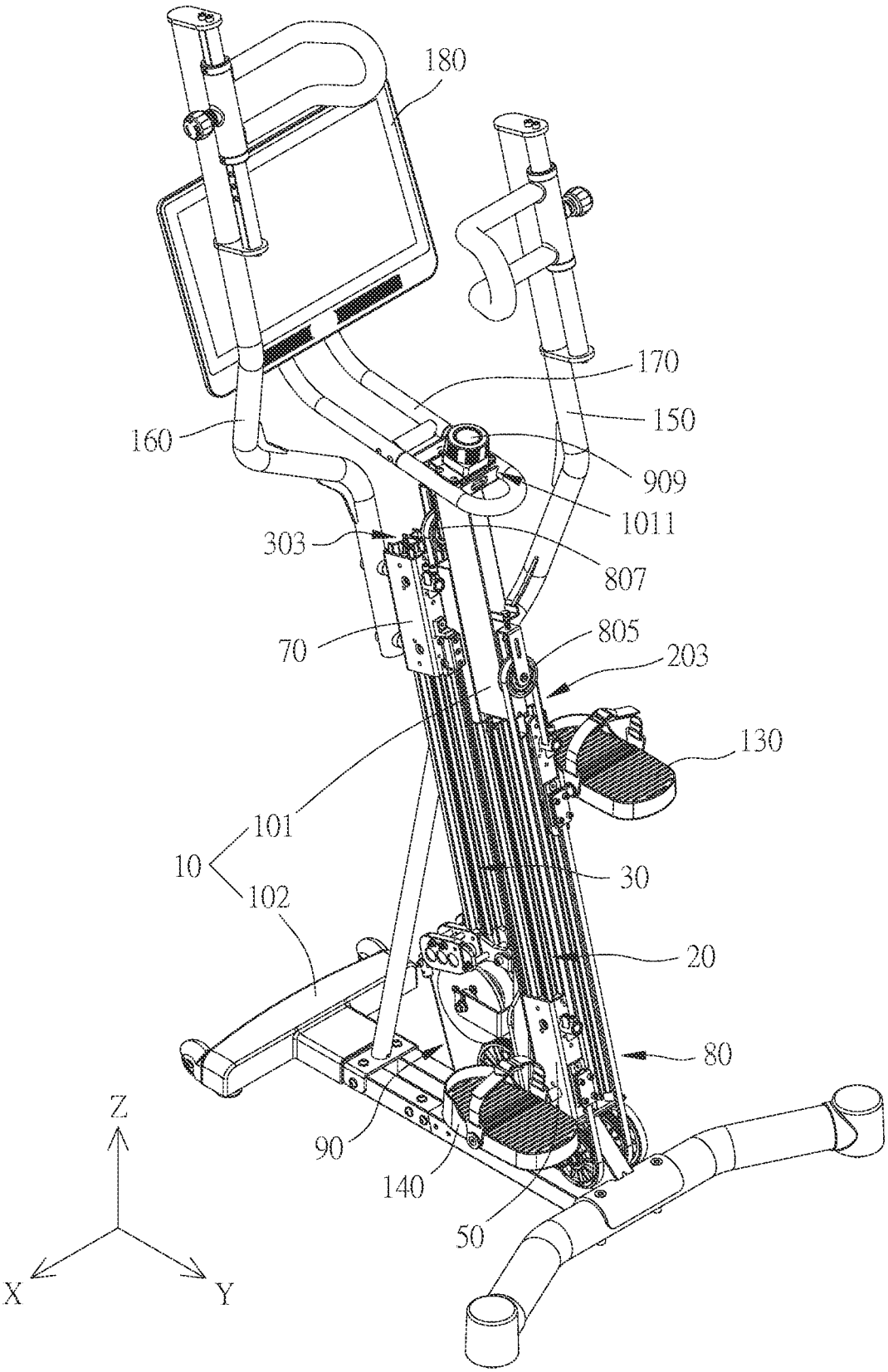
FIG. 1 is a left perspective view according to a first embodiment of the present invention.
Figure 1A:
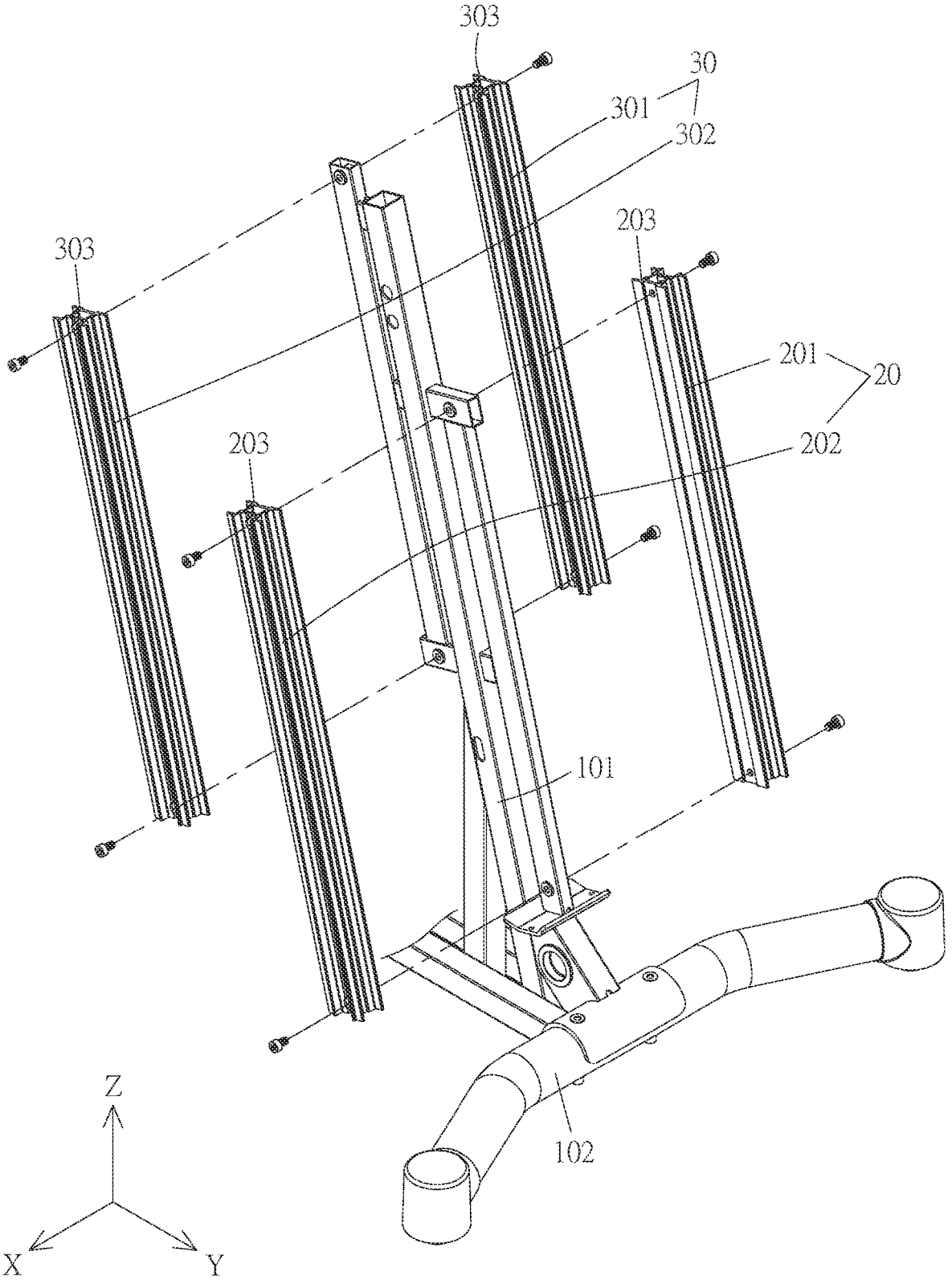
FIG. 1A is an exploded view of the support frame, the first slide rail assembly and the second slide rail assembly according to the first embodiment of the present invention.
Figure 2:
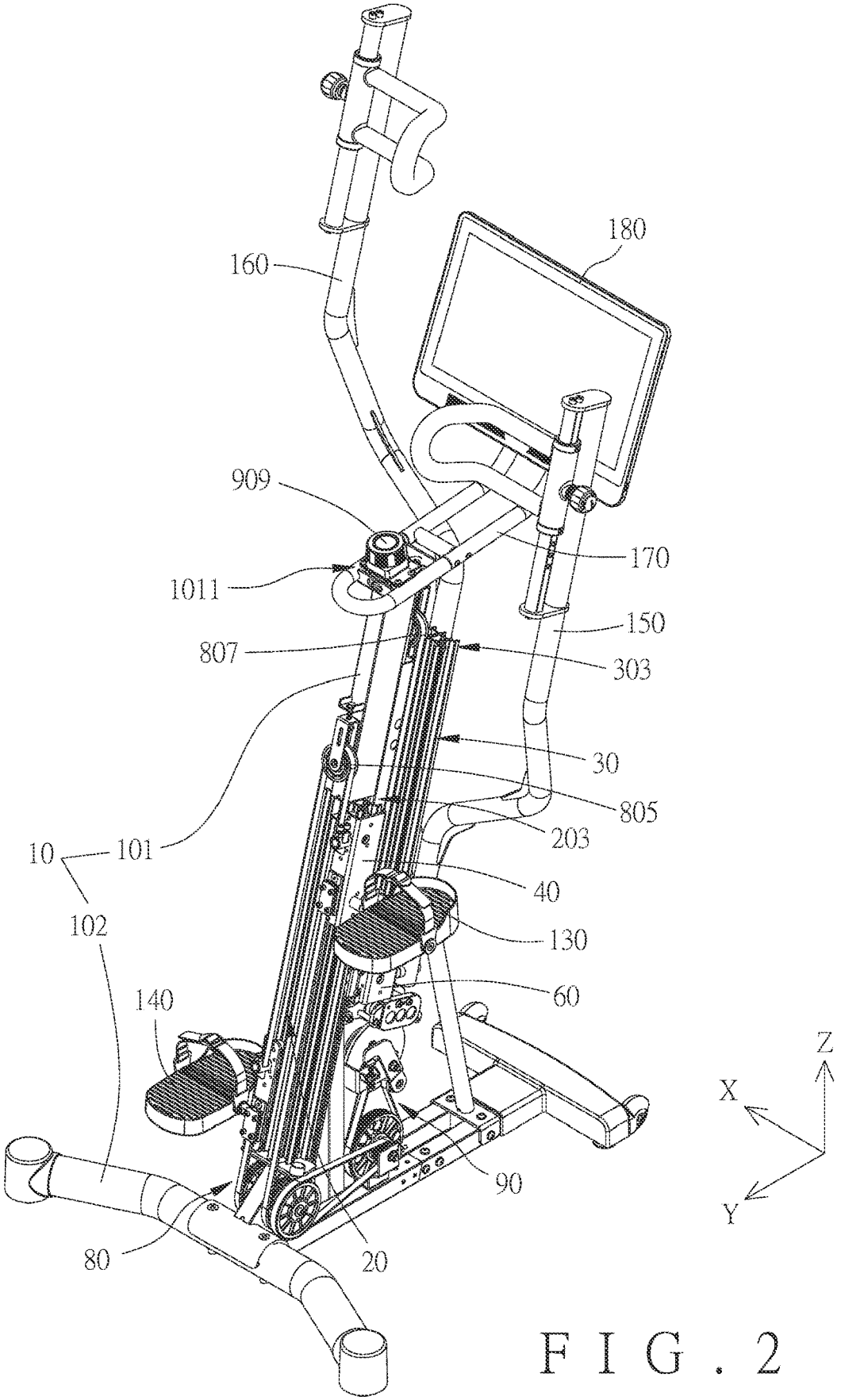
FIG. 2 is a right perspective view according to the first embodiment of the present invention.

The present invention discloses a climbing machine having a single circulating transmission path structure. FIG. 1, FIG. 1A and FIG. 2 illustrate a first embodiment of the present invention. The climbing machine comprises a frame body 10, a first slide rail assembly 20, a second slide rail assembly 30, a first pedal slider 40, a second pedal slider 50, a first handle slider 60, and a second handle slider 70. A transmission unit 80 and a resistance unit 90 are disposed on the frame body 10.

The frame body 10 includes a support frame 101 and a base 102. The base 102 is located on the XY plane. The support frame 101 stands on the base 102, and extends in the Z direction or extends obliquely relative to the Z direction. In this embodiment, the support frame 101 is slightly inclined forward. The uppermost end of the support frame 101 is defined as a support frame top end 1011.

The first slide rail assembly 20 and the second slide rail assembly 30 are spaced apart by a front-rear distance in the Y direction, and are arranged on the support frame 101 side by side. The uppermost end of the first slide rail assembly 20 is defined as a first slide rail top end 203. The uppermost end of the second slide rail assembly 30 is defined as a second slide rail top end 303. The first slide rail assembly 20 is relatively close to the operator A (referring to FIG. 8), and the second slide rail assembly 30 is relatively far from the operator A. Since the first slide rail assembly 20 and the second slide rail assembly 30 are arranged side by side, there is no need for the support frame 101 to be long, so that the height positions of the support frame top end 1011, the first slide rail top end 203 and the second slide rail top end 303 in the Z direction can be lowered. The first slide rail assembly 20 includes a first right slide rail 201 and a first left slide rail 202. The second slide rail assembly 30 includes a second right slide rail 301 and a second left slide rail 302. The first right slide rail 201 and the first left slide rail 202 are spaced apart by a left-right distance in the X direction, and are juxtaposed on the left and right sides of the support frame 101. The second right slide rail 301 and the second left slide rail 302 are also spaced apart by the left-right distance in the X direction, and are juxtaposed on the left and right sides of the support frame 101.

Please refer to FIG. 1A, FIG. 3, FIG. 4, FIG. 4A and FIG. 5. The first pedal slider 40 is slidably disposed on the first right slide rail 201. The second pedal slider 50 is slidably disposed on the first left slide rail 202. The first handle slider 60 is slidably disposed on the second right slide rail 301. The second handle slider 70 is slidably disposed on the second left slide rail 302.

The first pedal slider 40, the second pedal slider 50, the first handle slider 60 and the second handle slider 70 have the same structure. The first right slide rail 201, the first left slide rail 202, the second right slide rail 301 and the second left slide rail 302 have the same structure. As shown in FIG. 4A, the first pedal slider 40 and the first right slide rail 201 are taken as an example. The first right slide rail 201 includes three roller grooves 2011. The first pedal slider 40 includes three rotatable rollers 41 corresponding to the three roller grooves 2011. The three rollers 41 are located in the three roller grooves 2011, respectively. The first pedal slider 40 slides on the first right slide rail 201 through the rollers 41.

Figure 2A:
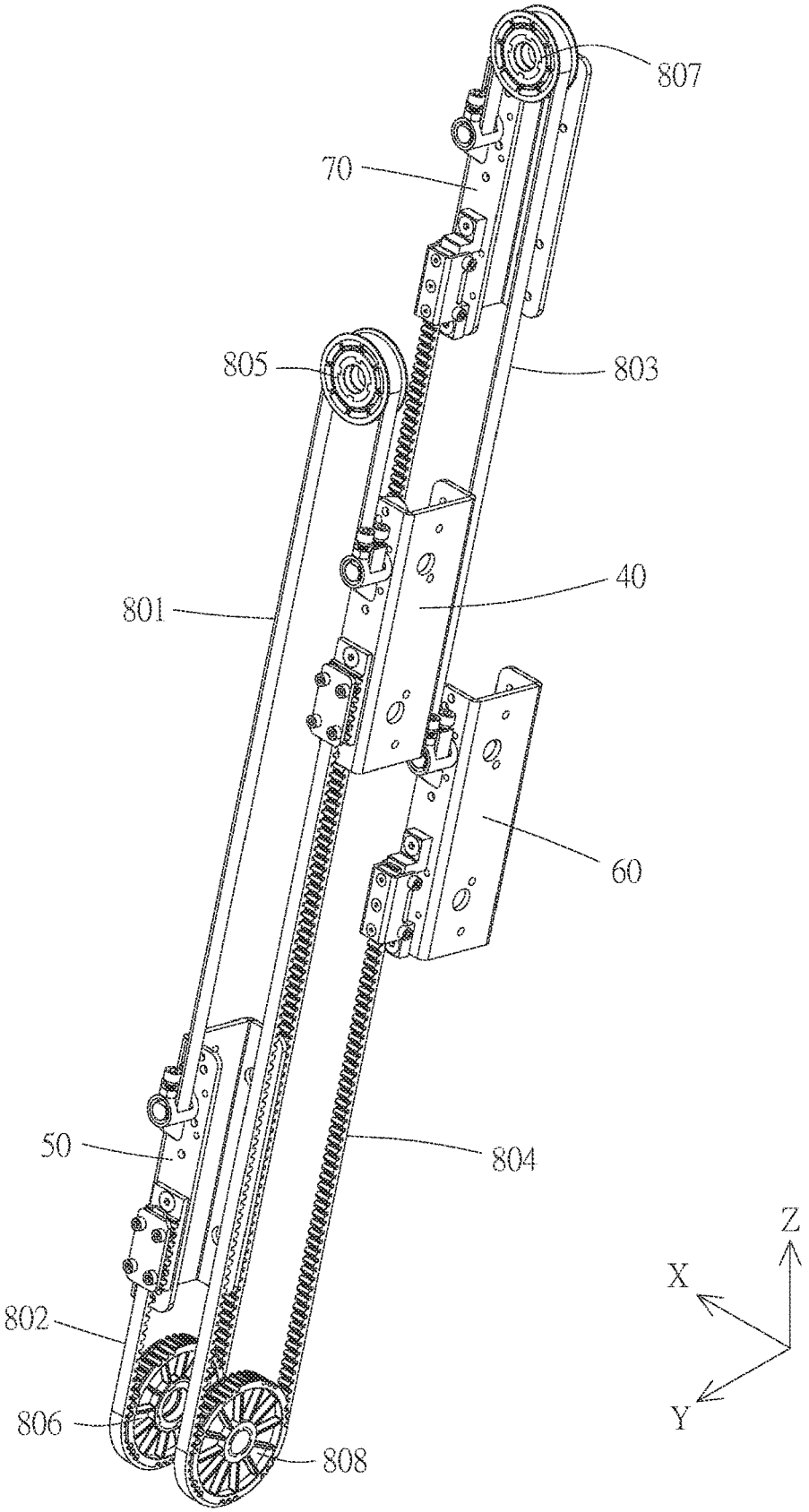
FIG. 2A is a schematic view of the transmission unit according to the first embodiment of the present invention.

Please refer to FIG. 2 and FIG. 2A. The transmission unit 80 includes a rolling assembly and a transmission assembly. The transmission assembly includes a first transmission member 801, a second transmission member 802, a third transmission member 803, and a fourth transmission member 804. The rolling assembly includes a first roller 805, a second roller 806, a third roller 807, and a fourth roller 808. The first transmission member 801, the second transmission member 802, the third transmission member 803 and the fourth transmission member 804 may be belts, timing belts, chains, steel cables, and the like.

Figure 3:
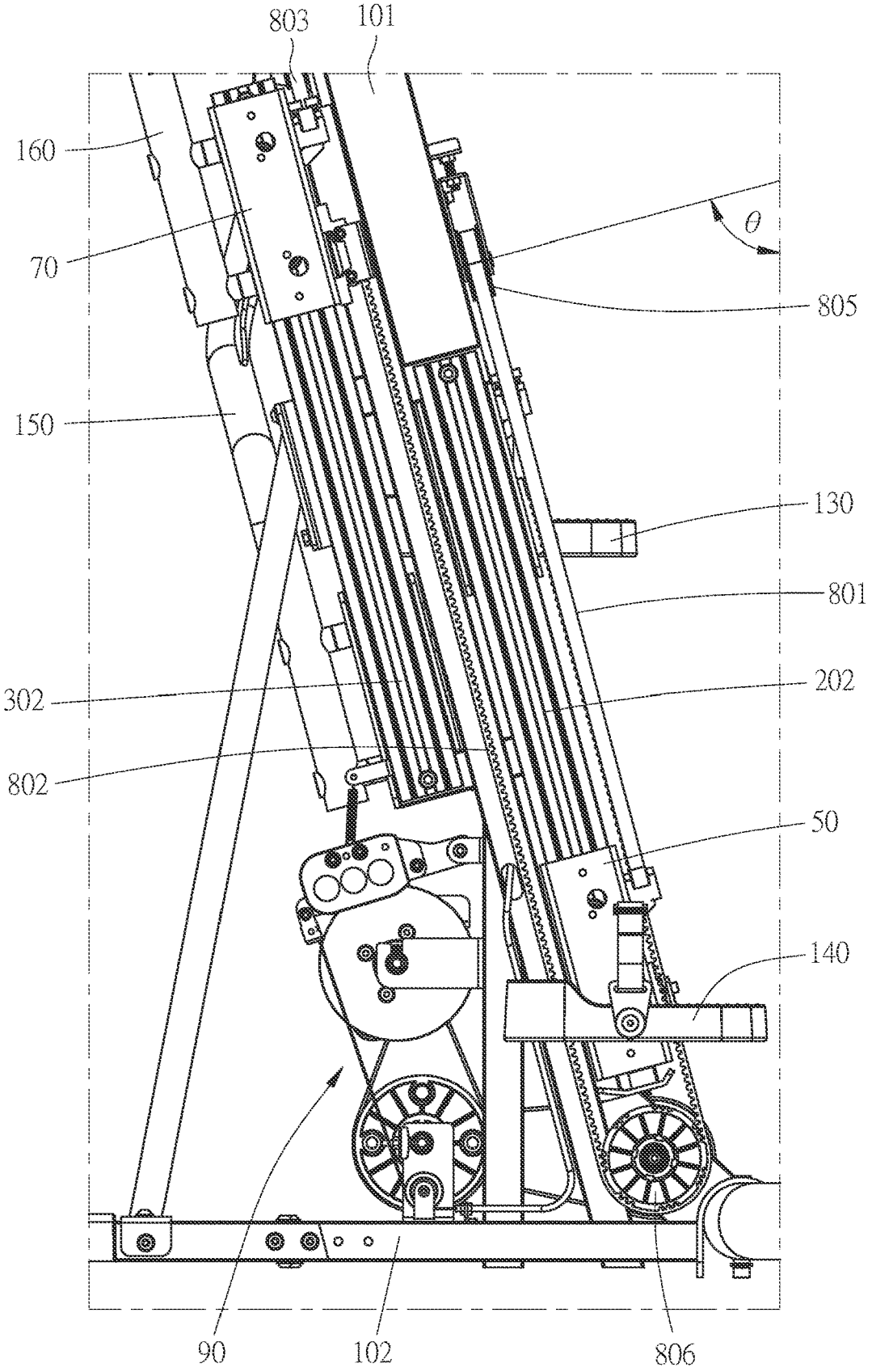
FIG. 3 is a left side view of the slide rails according to the first embodiment of the present invention.

Please refer to FIG. 2, FIG. 2A and FIG. 3. The first roller 805 and the third roller 807 are disposed at one end of the support frame 101 away from the base 102. The second roller 806 and the fourth roller 808 are disposed at the other end of the support frame 101 close to the base 102. The axis lines of the first roller 805 and the third roller 807 are parallel to each other. An included angle θ is defined between the axis line and the XZ plane. The included angle θ is between 70 degrees and 90 degrees. FIG. 3 only illustrates the included angle θ between the first roller 805 and the XZ plane, and does not illustrate the included angle θ between the third roller 807 and the XZ plane. The axis lines of the second roller 806 and the fourth roller 808 are parallel to the X direction. The included angle θ means the degree of inclination between the support frame 101 and the base 102.

Please refer to FIG. 2 and FIG. 2A. One end of the first transmission member 801 is connected to the first pedal slider 40 and looped around the first roller 805. The other end of the first transmission member 801 is connected to the second pedal slider 50. One end of the second transmission member 802 is connected to the second pedal slider 50 and looped around the second roller 806. The other end of the second transmission member 802 is connected to the second handle slider 70. One end of the third transmission member 803 is connected to the second handle slider 70 and looped around the third roller 807. The other end of the third transmission member 803 is connected to the first handle slider 60. One end of the fourth transmission member 804 is connected to the first handle slider 60 and looped around the fourth roller 808. The other end of the fourth transmission member 804 is connected to the first pedal slider 40.

Through the above-mentioned connection, the transmission assembly is continuously looped around the rolling assembly and continuously connects the first pedal slider 40, the second pedal slider 50, the second handle slider 70 and the first handle slider 60 to form a single circulating transmission path, such that the first pedal slider 40, the second pedal slider 50, the first handle slider 60 and the second handle slider 70 can slide on the first slide rail assembly 20 and the second slide rail assembly 30 synchronously through the transmission unit 80.

Please refer to FIG. 2A, FIG. 5 to FIG. 8. The transmission unit 80 is connected to the resistance unit 90. The resistance unit 90 includes a driving wheel 901, a first driven wheel 902, a second driven wheel 903, a third driven wheel 904, a resistance wheel 905, a fifth transmission member 906, a sixth transmission member 907, a resistance member 908, and a control member 909. The resistance member 908 may be a magnetoresistive member. The control member 909 is disposed on the frame body 10 and connected to the resistance member 908 and controlled manually or electrically.

The driving wheel 901, the fourth roller 808, and the second roller 806 are all disposed on a first rotating shaft 100. The driving wheel 901 and the fourth roller 808 are connected to the first rotating shaft 100 and rotated simultaneously along with the first rotating shaft 100. The second roller 806 idly rotates on the first rotating shaft 100 with a bearing.

The fifth transmission member 906 connects the driving wheel 901 and the first driven wheel 902. The first driven wheel 902 and the second driven wheel 903 are connected to a second rotating shaft 110 and rotated simultaneously along with the second rotating shaft 110. The sixth transmission member 907 connects the second driven wheel 903 and the third driven wheel 904. The third driven wheel 904 and the resistance wheel 905 are connected to a third rotating shaft 120 and rotated simultaneously along with the third rotating shaft 120. The resistance member 908 is disposed on the frame body 10 and adjacent to the resistance wheel 905.

The operator A controls the relative position between the resistance member 908 and the resistance wheel 905 by operating the control member 909 by himself, so that the resistance member 908 changes a resistance of the resistance wheel 905 to adjust the resistance during operation and enhance the training effect. The force from the driving wheel 901 is transmitted to the resistance wheel 905 through the fifth transmission member 906, the first driven wheel 902, the second driven wheel 903, the sixth transmission member 907 and the fifth transmission member 906 in sequence. This enables the operator A to feel the resistance when operating the single circulating transmission path structure of the climbing machine.

Figure 4:
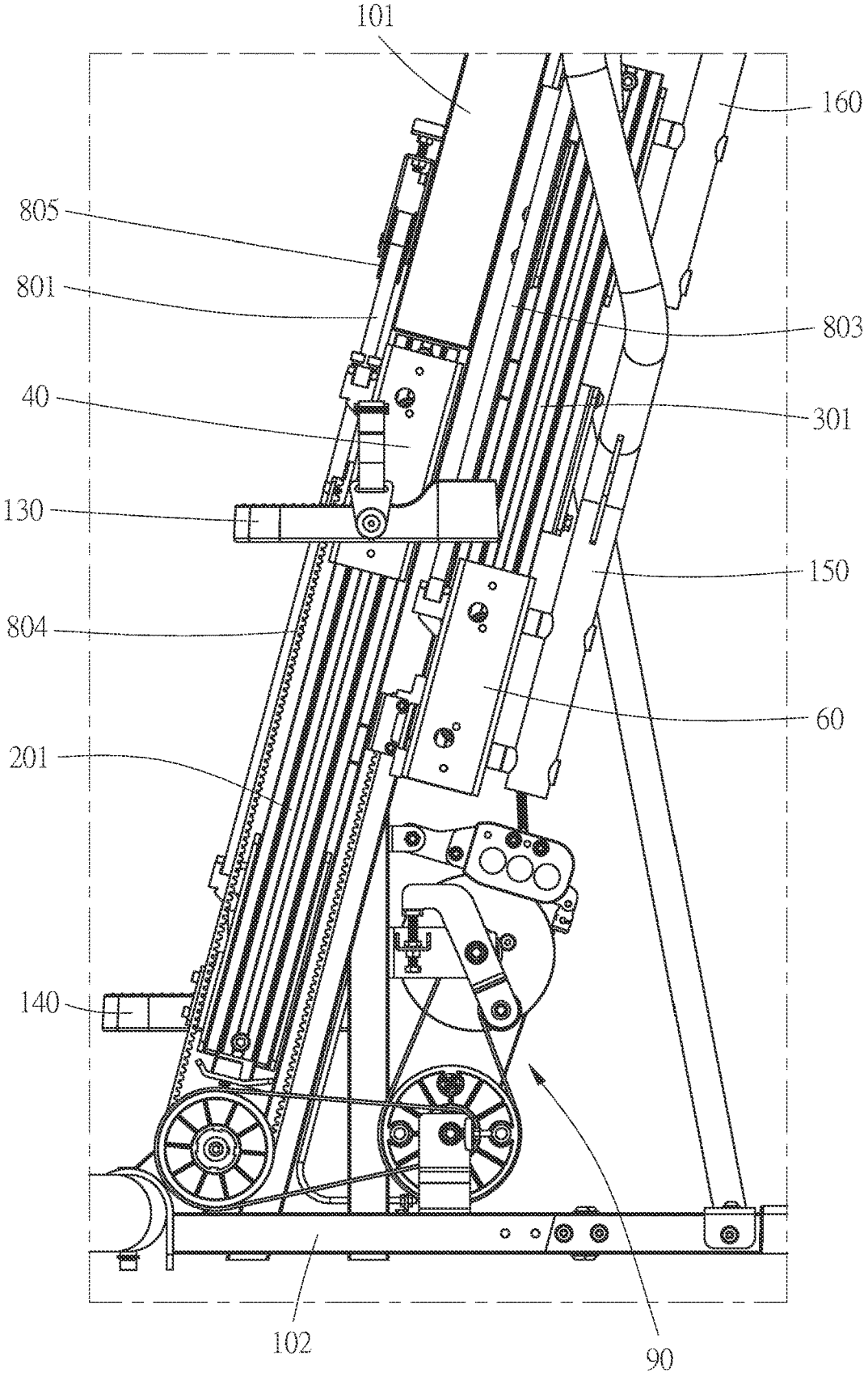
FIG. 4 is a right side view of the slide rails according to the first embodiment of the present invention.
Figure 4A:
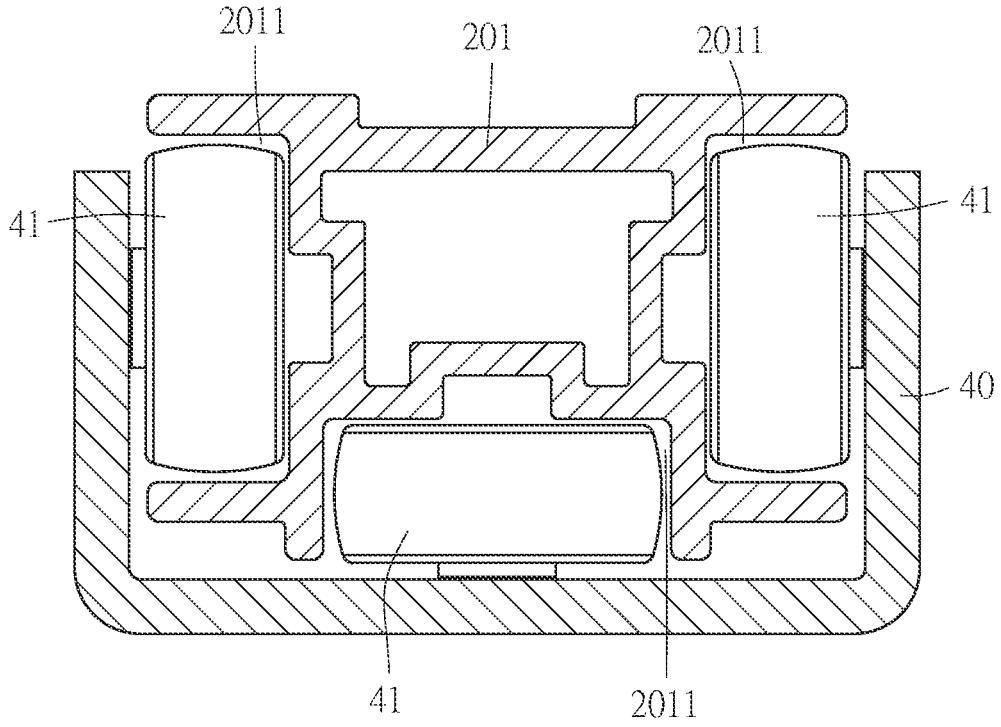
FIG. 4A is a cross-sectional view of the first right slide rail and the first pedal slider according to the first embodiment of the present invention.
Figure 5:
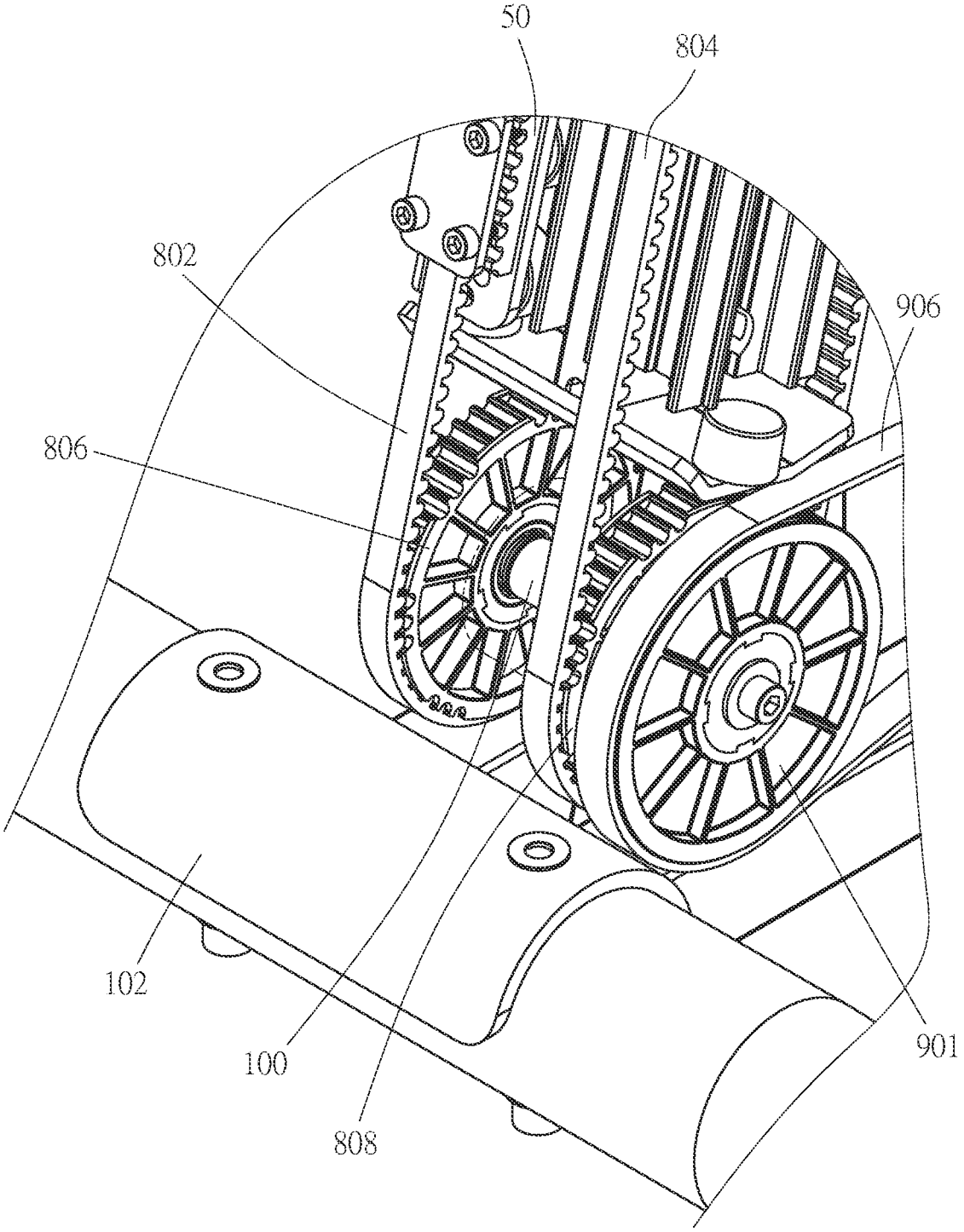
FIG. 5 is a partial enlarged view of the rolling assembly according to the first embodiment of the present invention.
Figure 5A:
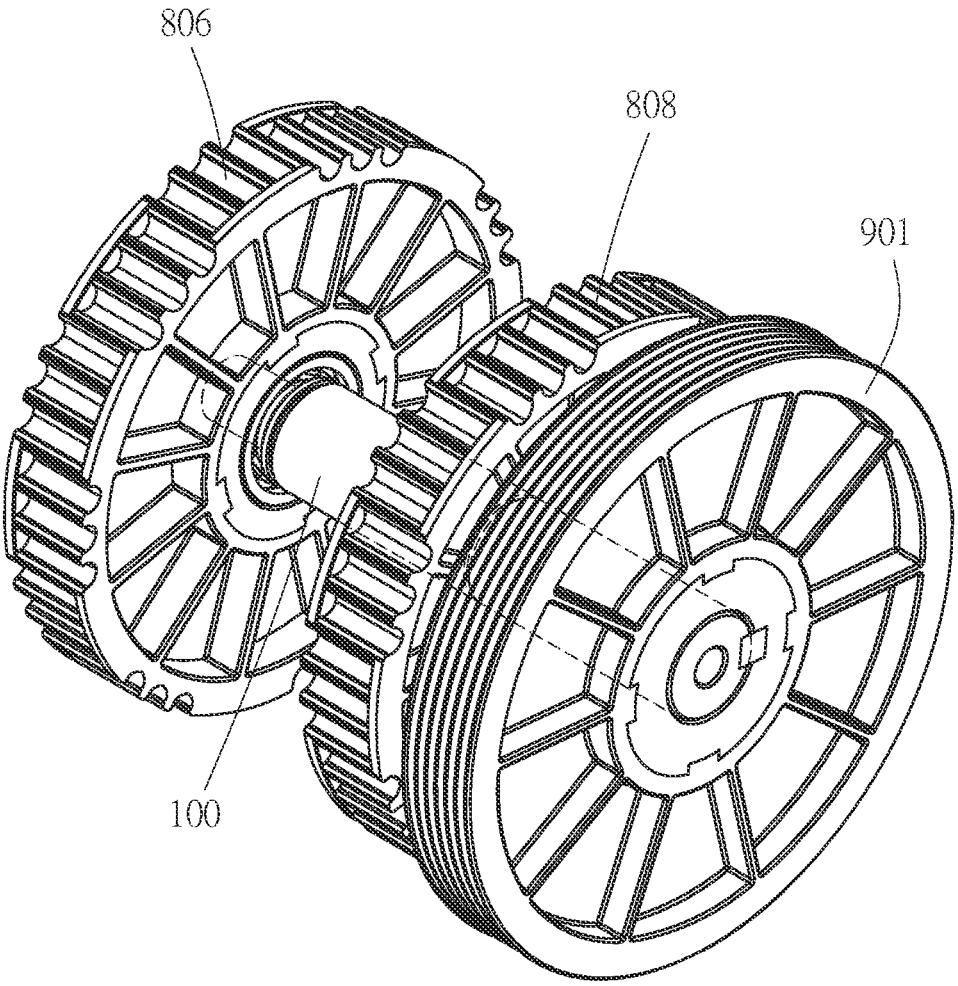
FIG. 5A is a schematic view of the driving wheel, the fourth roller, the second roller and the first rotating shaft according to the first embodiment of the present invention.
Figure 6:
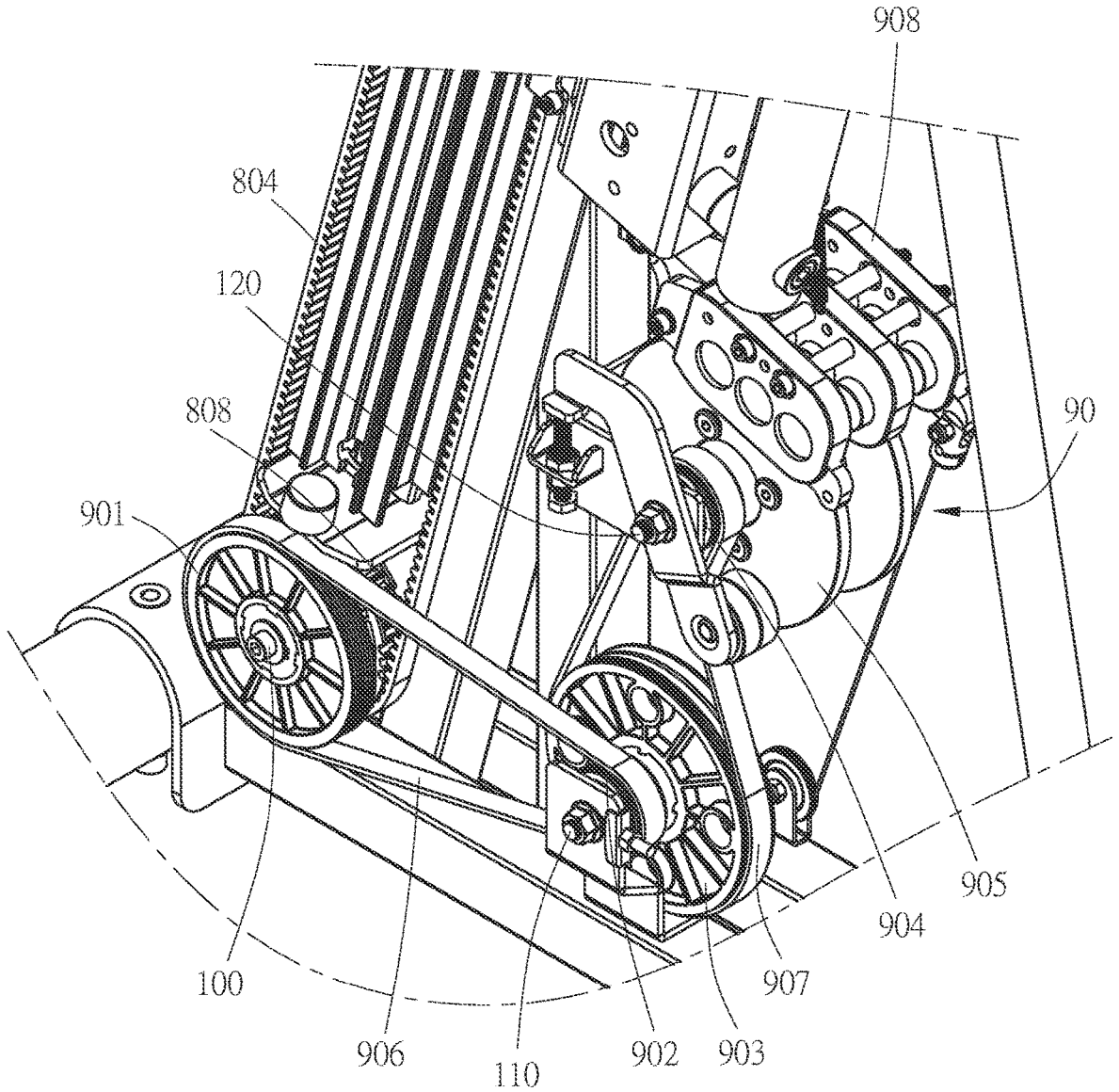
FIG. 6 is an enlarged view of the resistance unit according to the first embodiment of the present invention.
Figure 7:
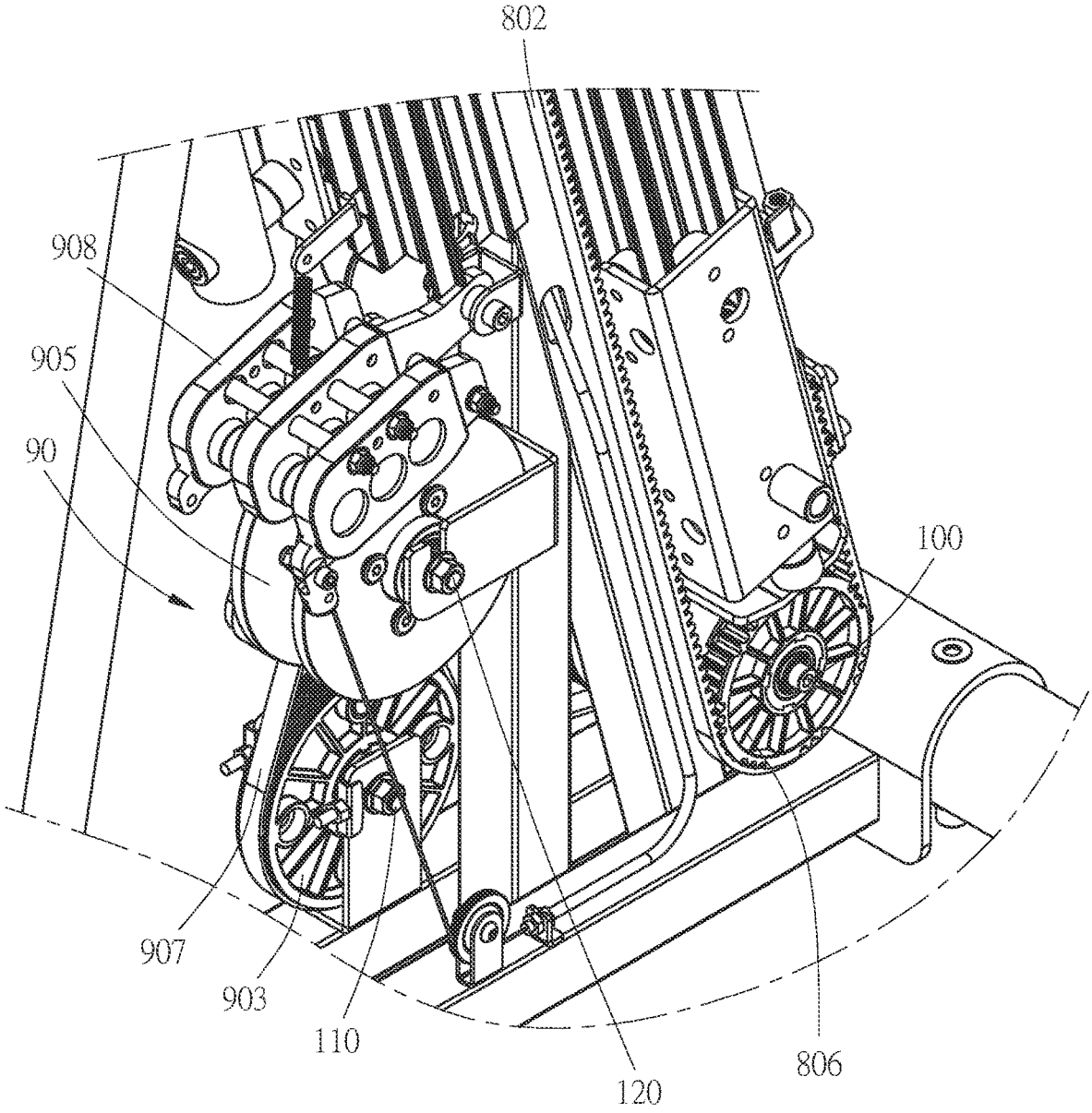
FIG. 7 is another enlarged view of the resistance unit according to the first embodiment of the present invention.
Figure 8:
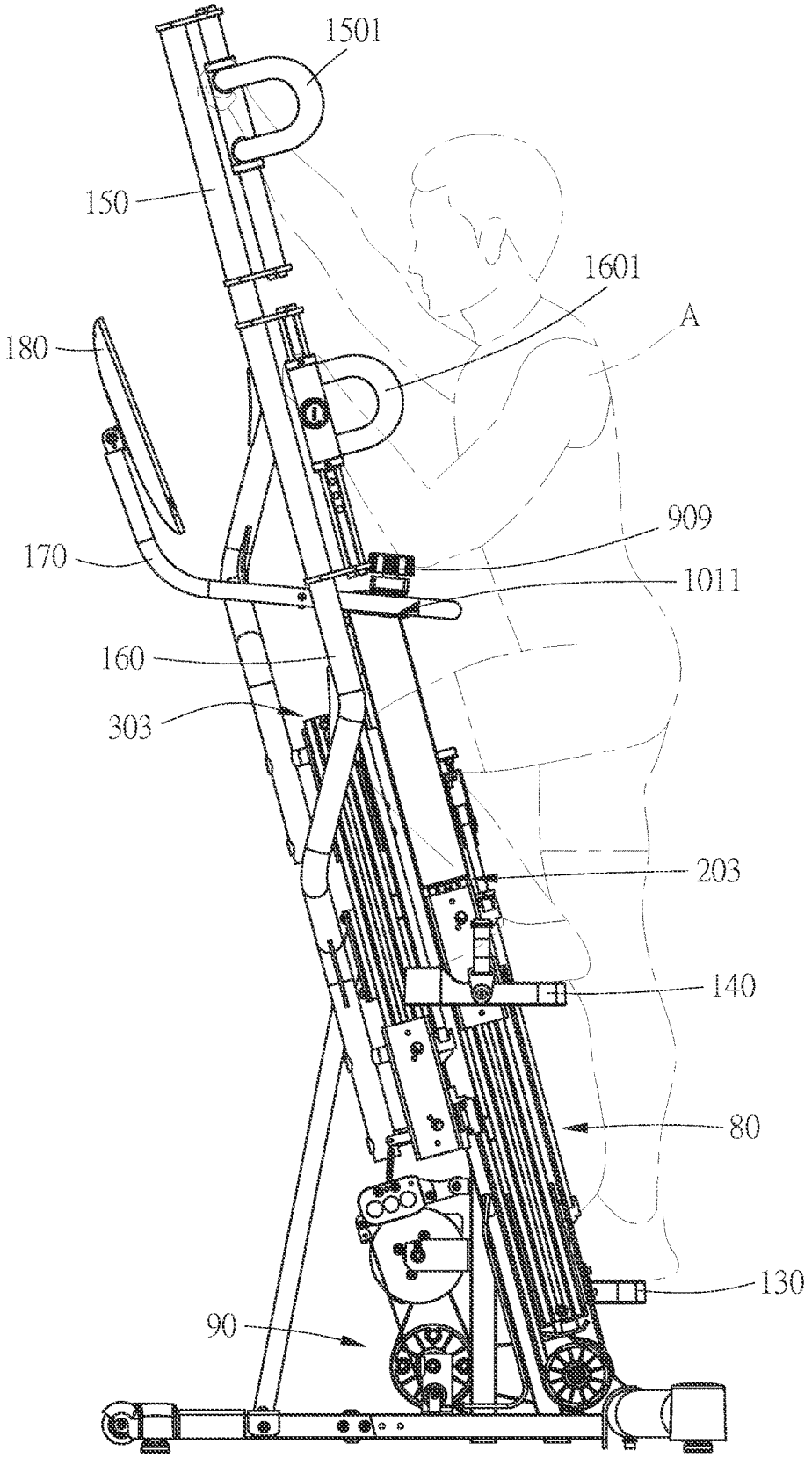
FIG. 8 is a left schematic view according to the first embodiment of the present invention when in use, wherein the operator's left foot and right hand are lifted.
Figure 9:
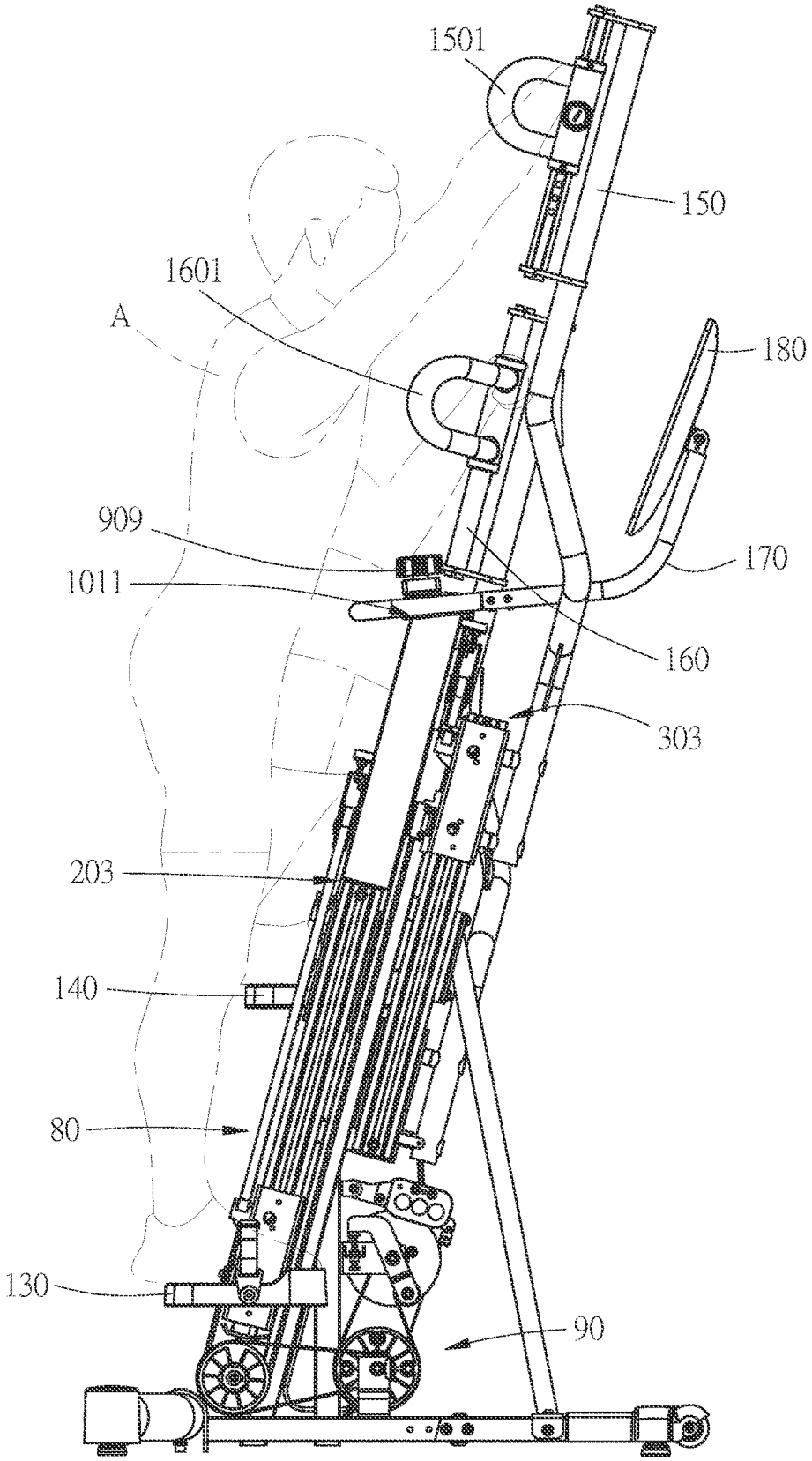
FIG. 9 is a right schematic view according to the first embodiment of the present invention when in use, wherein the operator's left foot and right hand are lifted.

Please refer to FIG. 8 and FIG. 9 in conjunction with FIG. 3 and FIG. 4. In order to facilitate the operation, a first pedal 130 is installed on the first pedal slider 40, a second pedal 140 is installed on the second pedal slider 50, a first handle 150 is installed on the first handle slider 60, and a second handle 160 is installed on the second handle slider 70. Furthermore, a display screen 180 is installed on a display screen stand 170 extending from the support frame 101, so that the operator A can view the information displayed on the display screen 180, such as operation-related parameters, videos, estimated calorie consumption, and the like.

Since the first right slide rail 201 and the first left slide rail 202 are juxtaposed on the left and right sides of the support frame 101 (i.e., the X direction), the second right slide rail 301 and the second left slide rail 302 are also juxtaposed on the left and right sides of the support frame 101, so that a certain left-right distance is defined between the first pedal 130 and the second pedal 140 and between the first handle 150 and the second handle 160. The left-right distance is preferably the distance between the feet and the hands of the operator A in an operating state.

When the operator A operates the climbing machine, similar to operating a conventional climbing machine, the operator A holds a first grip 1501 of the first handle 150 with his/her right hand, holds a second grip 1601 of the second handle 160 with his/her left hand, steps on the first pedal 130 with his/her right foot, and steps on the second pedal 140 with his/her left foot.

Please refer to FIG. 1A, FIG. 8 and FIG. 9. In operation, the height positions of the support frame top end 1011, the first slide rail top end 203 and the second slide rail top end 303 of the present invention are relatively low, and preferably are lower than the eye position of the operator A in the Z direction. In this way, the line of sight of the operator A won't be blocked by the support frame 101, the first slide rail assembly 20 and the second slide rail assembly 30, so the operator A can watch the display screen 180 smoothly.

Please refer to FIG. 2A, FIG. 8 and FIG. 9. When the operator A steps down with his/her right foot, the stepping force will be transmitted through the single circulating transmission path to drive the first pedal slider 40, the second pedal slider 50, the first handle slider 60 and the second handle slider 70 to slide. FIG. 8 and FIG. 9 show that right foot and left hand of the operator A are at the bottom dead center, and the left foot and right hand are at the top dead center.

Figure 10:
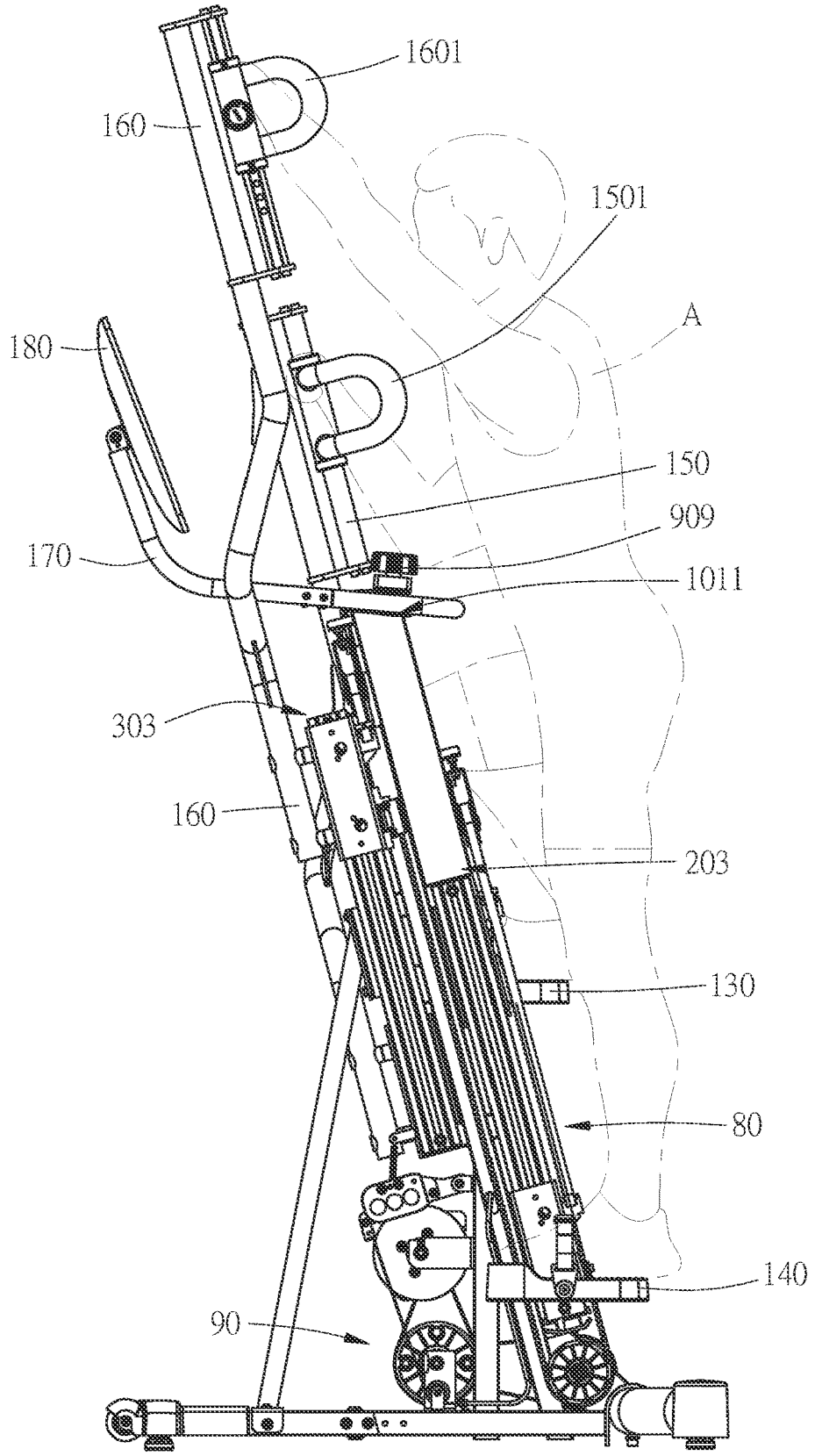
FIG. 10 is a left schematic view according to the first embodiment of the present invention when in use, wherein the operator's right foot and left hand are lifted.
Figure 11:
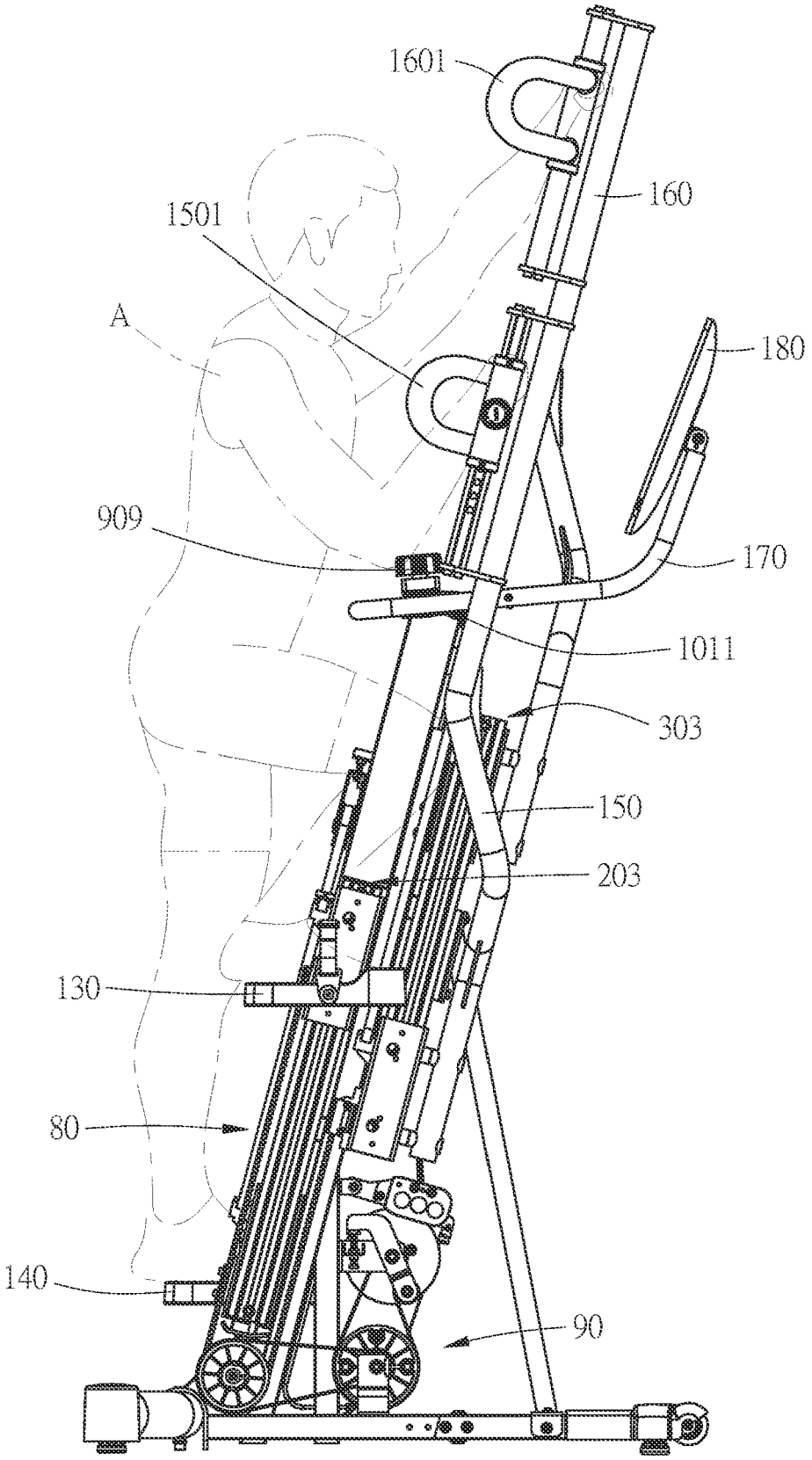
FIG. 11 is a right schematic view according to the first embodiment of the present invention when in use, wherein the operator's right foot and left hand are lifted.

Please refer to FIG. 2A, FIG. 10 and FIG. 11. When the operator A steps down with his/her left foot, the stepping force will be transmitted through the single circulating transmission path to drive the first pedal slider 40, the second pedal slider 50, the first handle slider 60 and the second handle slider 70 to slide reversely. FIG. 10 and FIG. 11 show that right foot and left hand of the operator A are at the top dead center, and the left foot and right hand are at the bottom dead center.

In operation, the right foot and the let foot of the operator A alternately tread on the first and second pedals 130, 140. Through the transmission of the single circular transmission path, the right hand and left hand of the operator A will interact up and down synchronously. The right foot and the right hand of the operator A will be close to or away from each other, and the left foot and the left hand will also be close to each other or away from each other. This conforms to the natural posture for climbing.

Figure 12:
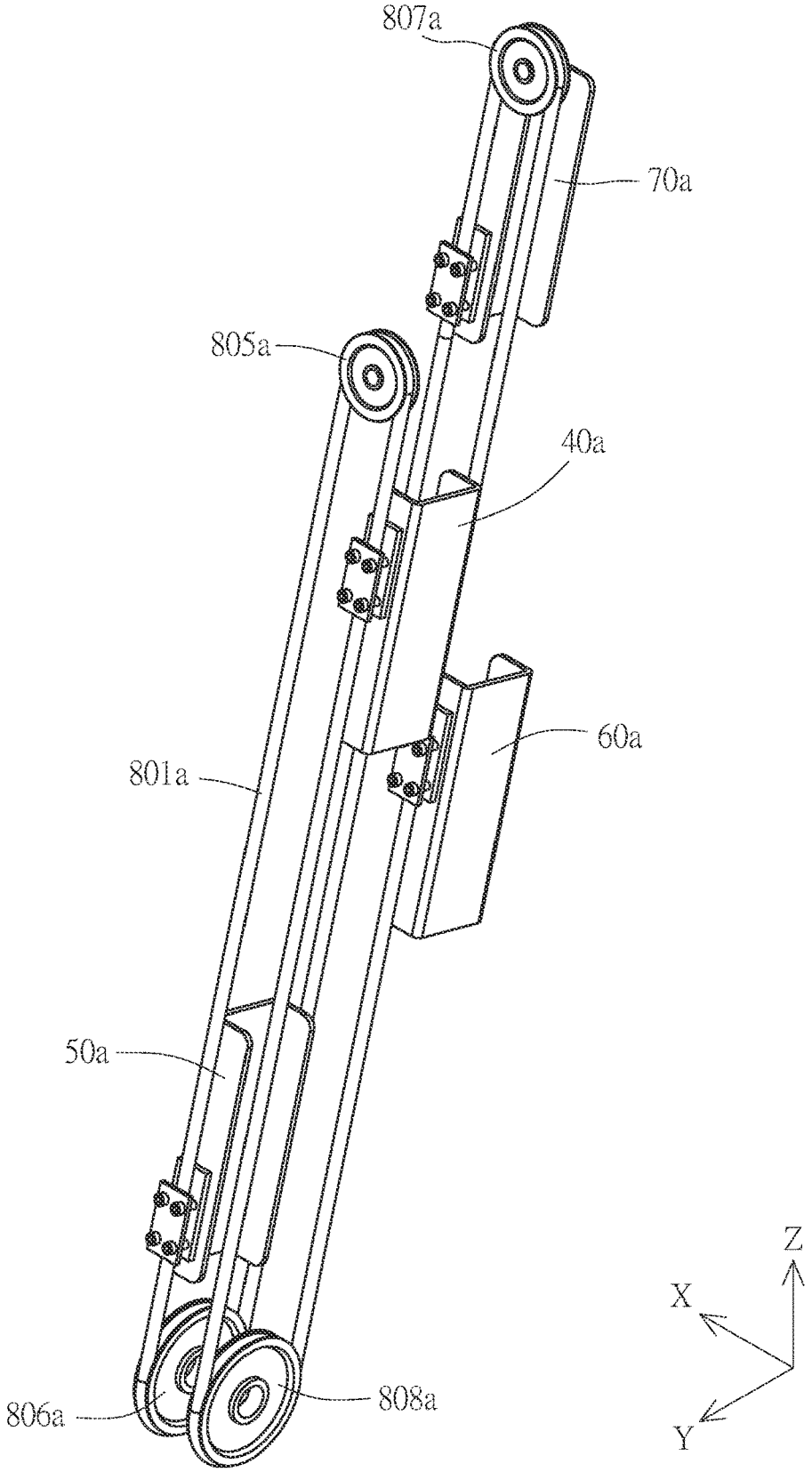
FIG. 12 is a schematic view according to a second embodiment of the present invention.
Figure 13:
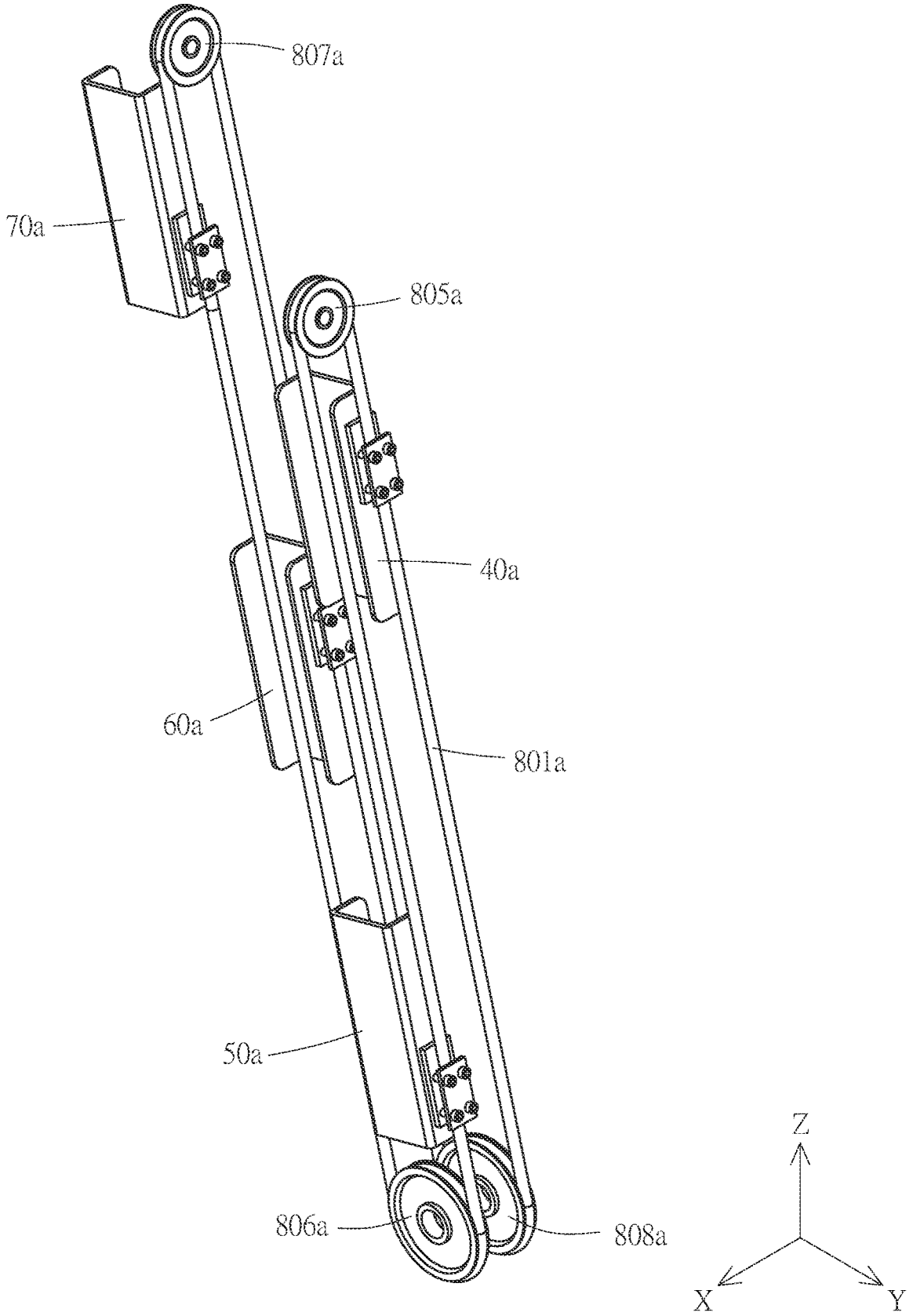
FIG. 13 is another schematic view according to the second embodiment of the present invention.

FIG. 12 and FIG. 13 illustrate a second embodiment of the present invention. The second embodiment is substantially similar to the first embodiment with the exceptions described hereinafter. In the first embodiment shown in FIG. 2A, the transmission assembly includes the first transmission member 801, the second transmission member 802, the third transmission member 803 and the fourth transmission member 804 that are connected to the first pedal slider 40, the second pedal slider 50, the second handle slider 70 and the first handle slider 60, respectively. In the second embodiment, the transmission assembly only includes a single transmission member 801*a*. More specifically, the first transmission member is directly connected to the second transmission member, the second transmission member is directly connected to the third transmission member and the third transmission member is directly connected to the fourth transmission member, so as to form the single transmission member 801*a*. The transmission member 801*a* may be a belt, a timing belt, a chain, a steel cable, or the like.

Similar to the first embodiment, the transmission member 801*a* is connected to the first pedal slider 40*a* and looped around the first roller 805*a*, is connected to the second pedal slider 50*a* and looped around the second roller 806*a*, is connected to the second handle slider 70*a* and looped around the third roller 807*a*, and is connected to the first pedal slider 60*a* and looped around the fourth roller 808*a*. Finally, the transmission member 801*a* circulates back to the first pedal slider 40*a* to form a single circulation transmission path.

The first pedal slider 40*a*, the second pedal slider 50*a*, the second handle slider 70*a* and the first handle slider 60*a* are respectively connected to the transmission member 801*a*, so that the first pedal slider 40*a*, the second pedal slider 50*a*, the second handle slider 70*a* and the first handle slider 60*a* can slide synchronously along with the cyclic movement of the transmission member 801*a*.

In order to illustrate the transmission path formed by the transmission member 801*a* better, only the transmission member 801*a*, the rolling assembly, the first pedal slider 40*a*, the second pedal slider 50*a*, the first handle slider 60*a* and the second handle slider 70*a* are shown in this embodiment. The rest of the single circulating transmission path structure of the climbing machine is not shown.

Figure 14:
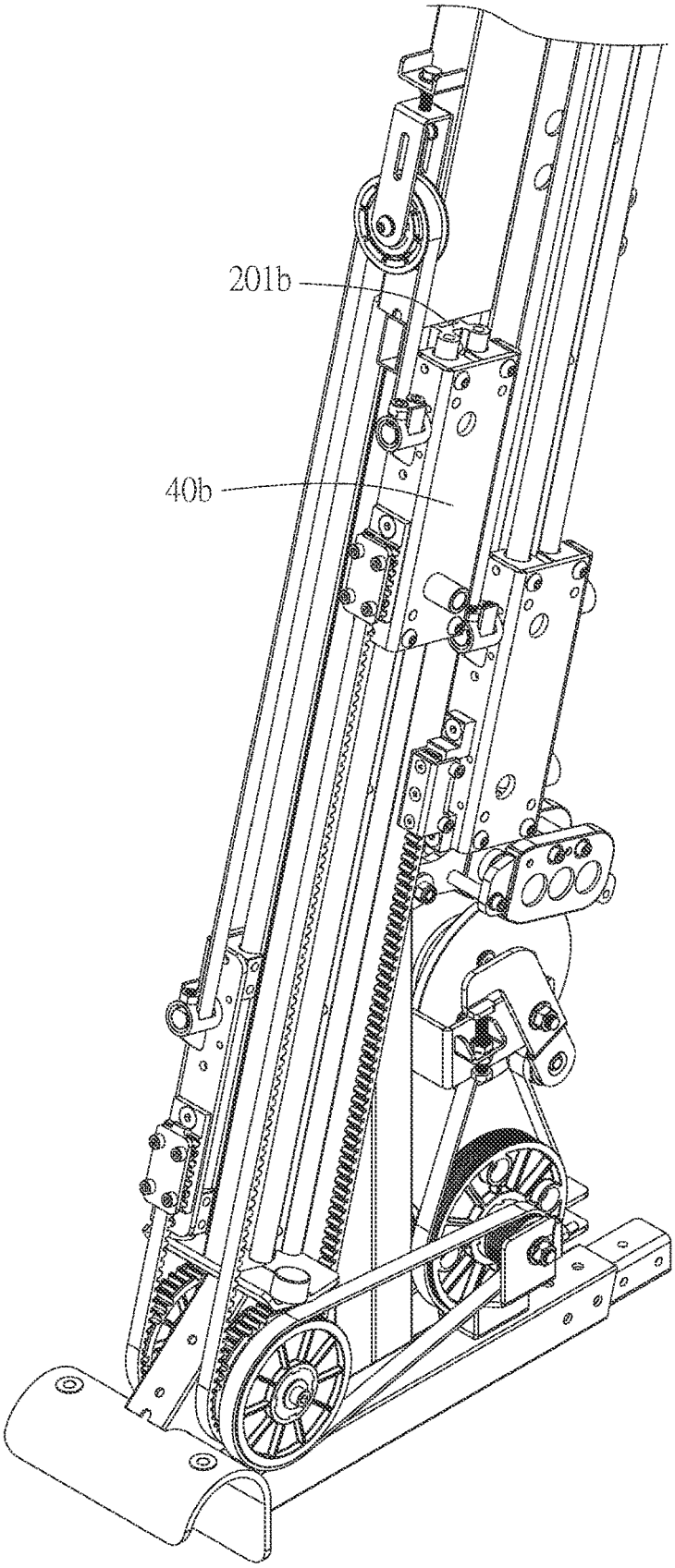
FIG. 14 is a schematic view of the present invention, wherein the rollers of the first pedal slider, the second pedal slider, the first handle slider and the second handle slider are replaced with the bushings, the first right rail, the first left rail, the second right rail and the second left rail are replaced with the guide rails, and the other parts of the climbing machine are not shown in the figure.
Figure 15:
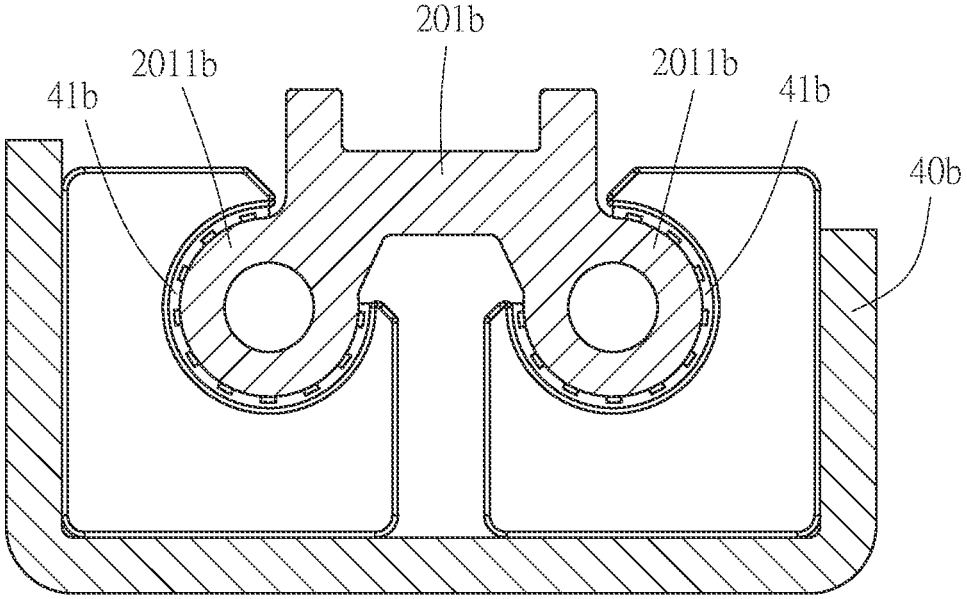
FIG. 15 is a cross-sectional view of the bushings of the first pedal slider and the first right slide rail of the present invention.

Please refer to the FIG. 1A, FIG. 2A and FIG. 12. With the cooperation of the first rollers 805, 805*a*, the second rollers 806, 806*a*, the third rollers 807, 807*a* and the fourth rollers 808, 808*a*, the transmission assembly can form the single circulating transmission path smoothly through the first transmission member 801, the second transmission member 802, the third transmission member 803 and the fourth transmission member 804 of the first embodiment or through the single transmission member 801*a* of the second embodiment. In the above-mentioned two embodiments, the first pedal slider 40, the second pedal slider 50, the first handle slider 60 and the second handle slider 70 slide on the first right slide rail 201, the first left slide rail 202, the second right slide rail 301 and the second left slide rail 302 respectively through the rolling members. As shown in FIG. 4A, taking the first pedal slider 40 as an example, the rolling members are the rollers 41. However, in addition to the rollers, the first pedal slider 40, the second pedal slider 50, the first handle slider 60 and the second handle slider 70 of the present invention may slide on the first right slide rail 201, the first left slide rail 202, the second right slide rail 301 and the second left slide rail 302 by other means. For example, referring to FIG. 14 and FIG. 15, the first right slide rail 201*b* includes two guide rails 2011*b*. The first pedal slider 40*b* includes two bushings 41*b* corresponding to the two guide rails 2011*b*. Each bushing 41*b* is fitted on the guide rail 2011*b*. The first pedal slider 40*b* slides on the first right slid rail 201*b* through the bushings 41*b*. In the first embodiment and the second embodiment, part of the first pedal slider 40, the second pedal slider 50, the first handle slider 60 and the second handle slider 70 slide on the first right slide rail 201, the first left slide rail 202, the second right slide rail 301 and the second left slide rail 302 through rollers, and the other part of the sliders slide on the slide rails through the bushings. It is a feasible embodiment of the present invention to adopt a combination of rollers and bushings.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A climbing machine having a single circulating transmission path structure, comprising:

a frame body, including a support frame and a base, the base being located on an XY plane, the support frame standing on the base and extending in a Z direction or extending obliquely relative to the Z direction, the XY plane being formed by an X direction and a Y direction that are perpendicular to each other, the Z direction being perpendicular to the XY plane, the X direction and the Z direction forming an XZ plane, the Y direction and the Z direction form a YZ plane;

a first slide rail assembly, including a first right slide rail and a first left slide rail that are disposed on the support frame;

a second slide rail assembly, including a second right slide rail and a second left slide rail that are disposed on the support frame;

a first pedal slider, slidably disposed on the first right slide rail;

a second pedal slider, slidably disposed on the first left slide rail;

a first handle slider, slidably disposed on the second right slide rail;

a second handle slider, slidably disposed on the second left slide rail; and a transmission unit, disposed on the support frame;

characterized in that:

the transmission unit includes a rolling assembly and a transmission assembly, the transmission assembly includes a first transmission member, a second transmission member, a third transmission member, and a fourth transmission member, the rolling assembly includes a first roller, a second roller, a third roller and a fourth roller, one end of the first transmission member is connected to the first pedal slider and looped around the first roller, another end of the first transmission member is connected to the second pedal slider; one end of the second transmission member is connected to the second pedal slider and looped around the second roller, another end of the second transmission member is connected to the second handle slider; one end of the third transmission member is connected to the second handle slider and looped around the third roller, another end of the third transmission member is connected to the first handle slide; one end of the fourth transmission member is connected to the first handle slider and looped around the fourth roller, and another end of the fourth transmission member is connected to the first pedal slider, such that the first pedal slider, the second pedal slider, the first handle slider and the second handle slider slide on the first slide rail assembly and the second slide rail assembly synchronously through the transmission unit.

2. The climbing machine as claimed in claim 1, wherein the first right slide rail and the first left slide rail are spaced apart by a distance in the X direction and are juxtaposed on the support frame, the second right slide rail and the second left slide rail are spaced apart by the distance in the X direction and are juxtaposed on the support frame.

3. The climbing machine as claimed in claim 1, further comprising a resistance unit disposed on the frame body, the transmission unit being connected to the resistance unit.

4. The climbing machine as claimed in claim 3, wherein the resistance unit includes a driving wheel, a first driven wheel, a second driven wheel, a third driven wheel, a resistance wheel, a fifth transmission member, a sixth transmission member, and a resistance member, the driving wheel, the fourth roller and the second roller are all disposed on a first rotating shaft, the driving wheel and the fourth roller are connected to the first rotating shaft and rotated simultaneously along with the first rotating shaft, the second roller idly rotates on the first rotating shaft, the fifth transmission member connects the driving wheel and the first driven wheel, the first driven wheel and the second driven wheel are connected to a second rotating shaft and rotated simultaneously along with the second rotating shaft, the sixth transmission member connects the second driven wheel and the third driven wheel, the third driven wheel and the resistance wheel are connected to a third rotating shaft and rotated simultaneously along with the third rotating shaft, the resistance member is disposed on the frame body and adjacent to the resistance wheel; a resistance of the resistance wheel is controlled by the resistance member, and a force from the driving wheel is transmitted to the resistance wheel through the fifth transmission member, the first driven wheel, the second driven wheel, the sixth transmission member and the fifth transmission member in sequence.

5. The climbing machine as claimed in claim 4, wherein the first roller and the third roller are disposed at one end of the support frame away from the base, an included angle θ is defined between an axis lines of each of the first roller and the third roller and the XZ plane, the included angle θ is between 70 degrees and 90 degrees, the second roller and the fourth roller are disposed at another end of the support frame adjacent to the base, and an axis line of the first rotating shaft is parallel to the X direction.

6. The climbing machine as claimed in claim 4, wherein the resistance member is a magnetoresistive member, the resistance unit further includes a control member disposed on the frame body, the control member is connected to the magnetoresistive member; and the control member is configured to control a relative position between the magnetoresistive member and the resistance wheel to change the resistance of the resistance wheel.

7. The climbing machine as claimed in claim 1, wherein the first slide rail assembly and the second slide rail assembly are spaced apart by a distance in the Y direction and are arranged on the support frame side by side, the support frame has a support frame top end, the first slide rail assembly has a first slide rail top end, the second slide rail assembly has a second slide rail top end, and the first slide rail top end and the second slide rail top end are both lower than the support frame top end.

8. The climbing machine as claimed in claim 1, wherein a first pedal is connected to the first pedal slider, a second pedal is connected to the second pedal slider, a first handle is connected to the first handle slider, and a second handle is connected to the second handle slider.

9. A climbing machine having a single circulating transmission path structure, comprising:

a frame body, including a support frame and a base, the base being located on an XY plane, the support frame standing on the base and extending in a Z direction or extending obliquely relative to the Z direction, the XY plane being formed by an X direction and a Y direction that are perpendicular to each other, the Z direction being perpendicular to the XY plane, the X direction and the Z direction forming an XZ plane, the Y direction and the Z direction form a YZ plane;

a first slide rail assembly, including a first right slide rail and a first left slide rail that are disposed on the support frame;

a second slide rail assembly, including a second right slide rail and a second left slide rail that are disposed on the support frame;

a first pedal slider, slidably disposed on the first right slide rail;

a second pedal slider, slidably disposed on the first left slide rail;

a first handle slider, slidably disposed on the second right slide rail;

a second handle slider, slidably disposed on the second left slide rail; and a transmission unit, disposed on the support frame;

characterized in that:

the transmission unit includes a rolling assembly and a single transmission member, the transmission member is continuously looped around the rolling assembly and continuously connects the first pedal slider, the second pedal slider, the second handle slider and the first handle slider to form a single transmission path, the rolling assembly includes a first roller, a second roller, a third roller and a fourth roller, the transmission member includes a first transmission member portion extending between the first pedal slider and the second pedal slider and being looped around the first roller, a second transmission member portion extending between the second pedal slider and the second handle slider and looped around the second roller, a third transmission member portion connected between the second handle slider and the first handle slider and looped around the third roller, and a fourth transmission member portion extending between the first handle slider and the first pedal slider and looped around the fourth roller, wherein the first pedal slider, the second pedal slider, the first handle slider and the second handle slider slide synchronously on the first slide rail assembly and the second slide rail assembly.

* * * * *